US005423278A

United States Patent [19]

Lashman

[11] Patent Number: 5,423,278

[45] **Date of Patent: * Jun. 13, 1995**

[54] SUBMERSIBLE MARINE VESSEL

[75] Inventor: Morton E. Lashman, Fort Lauderdale, Fla.

[73] Assignee: Mode Industries, Inc., Fort Lauderdale, Fla.

[ * ] Notice: The portion of the term of this patent subsequent to Apr. 19, 2011 has been disclaimed.

[21] Appl. No.: 226,869

[22] Filed: Apr. 13, 1994

Related U.S. Application Data

[63] Continuation-in-part of Ser. No. 958,774, Oct. 9, 1992, Pat. No. 5,303,666.

[51] Int. Cl.[6] ..... B63C 11/46

[52] U.S. Cl. ..... 114/315; 440/6

[58] Field of Search ..... 114/315, 343; 446/132; 440/6, 7; D12/308

[56] References Cited

U.S. PATENT DOCUMENTS

| | | | |
|---|---|---|---|
| D. 323,808 | 2/1992 | De Santis | D12/308 |
| 3,442,240 | 5/1969 | Wild et al. | 114/315 |
| 3,466,798 | 9/1969 | Speers et al. | 446/132 |
| 3,584,594 | 6/1971 | Poutout | 214/315 |
| 3,685,480 | 8/1972 | Peroni | 114/315 |
| 3,916,814 | 11/1975 | Bardoni et al. | 440/6 |
| 3,929,533 | 12/1975 | Horn | 114/66 |
| 4,864,959 | 9/1989 | Takamizawa et al. | 440/6 |
| 4,996,938 | 3/1991 | Cameron et al. | 440/6 |
| 5,105,753 | 4/1992 | Chih et al. | 114/315 |
| 5,158,034 | 10/1992 | Hsu | 214/315 |

*Primary Examiner*—Stephen Avila
*Attorney, Agent, or Firm*—Melvin K. Silverman

[57] ABSTRACT

A submersible marine vehicle, operable both upon and beneath water, includes a fluid-tight hull elongated along a longitudinal axis corresponding to an intended direction of travel of the vehicle, the hull having integral gripping elements and velocity controls proximal to each of the gripping elements, the hull further including internally energy storage elements for power control and transfer within an air space in the hull, the air space also defining a buoyancy characteristic of the vehicle, the hull defining a total longitudinal dimension co-linear to the longitudinal axis of the hull. The vehicle also includes a single circumferentially integral propeller shroud depending integrally downwardly from a lower surface of the hull along an axis transverse to the axis of the hull. A propeller and motor are mounted within the shroud parallel to the axis of the hull, the propeller having a diameter approximately equal to the interior diameter of the, shroud, the propeller and motor defining an aggregate longitudinal dimension parallel to the axis of the hull, the aggregate dimension falling in the range of about 60% to about 110% of the aggregate longitudinal dimension of the hull and handle gripping elements, the motor in electrical communication with the power transfer elements within the hull and subject to actuation by the velocity control elements.

13 Claims, 4 Drawing Sheets

SUBMERSIBLE MARINE VESSEL

REFERENCE TO RELATED APPLICATION

This case is a continuation-in-part of application Ser. No. 07/958,774, filed Oct. 9, 1992, now U.S. Pat. No. 5,303,666.

BACKGROUND OF THE INVENTION

The present invention relates to submersible marine vehicles, operable both upon and beneath water, of a type adapted for use by a scuba diver. The prior art of vehicles of this type has, for the most part, consisted of elongated cylindrical-tubular structures upon which the scuba diver could ride. Such prior art vehicles presented difficulty in the control and maneuverability thereof and, as well, posed something of a safety hazard in that the foot gear of the diver could become entangled within the propeller of such vehicles. Also, the backwash or wake of such vehicles occurred just beneath the body of the diver such that water, including fish and plant life, therein was subjected to turbidity and generalized churning because of the location of the propeller.

Certain prior art know to the inventors, for example, U.S. Pat. No. 3,466,798 (1969) to Speers, entitled Toy Vessel For Use in Water, employed a horizontal plane configuration which did not address any of the above described shortcomings of the prior art.

Other art known to the inventor, for example, U.S. Pat. No. 3,584,593 (1971) to Poutout, entitled Self-propelled Submarine Device, employs a small propeller that is not surrounded by a protective shroud of the type of the present invention. It, as well, employs a different fluid-dynamic configuration. Poutout, as well, relates primarily to a snorkeling type device. It, as well, provides for handle means which are as far behind the propeller thereof, as the propeller of Poutout is behind the nose of the device. Also, the depth of such handle is substantially the same as the depth of the propeller and related motor. As such, a diver attempting to use the device of Poutout would find himself caught within the wake of the propeller and, because of the location of the handles far behind the body proper of Poutout, he would find it most difficult to maneuver the resultant device. Because of the reliance in Poutout upon a snorkel, its basic use is not that of a diving device. It is, accordingly, for such reasons that the length and location of the handles thereof are not of primary concern.

Other personal underwater vehicles known to the inventor are reflected in U.S. Pat. Nos. 3,685,480 (1972) to Peroni and 5,105,753 (1992) to Chih. Further art in the area of underwater propulsion means known to the Applicant is U.S. Pat. No. 3,916,814 (1975) to Bardoni et al, entitled Underwater Propulsion Devices. The device of Bardoni teaches a motor and propeller assembly for connection onto the top of the breathing tank of a breathing unit worn on the back of an underwater swimmer. The motor and propeller unit is surrounded by a cover which does not provide for flow-through of water. Applicant's device, in distinction, makes use of a bottom-located shroud which is axially hollow and which is far enough beneath the body proper thereof to assure that the diver will not be affected by the wake of the propeller.

The instant invention addresses the above various set forth limitations of the prior art, providing a structure in which the propeller thereof is separated, both vertically and horizontally, from the body of the diver and which, as well, provides improved maneuverability versus prior art submersible marine vehicles suitable for use by scuba divers and the like.

SUMMARY OF THE INVENTION

The invention constitutes a submersible marine vessel, operable both upon and beneath water, the vessel particularly comprising a fluid-tight elongated hull having a longitudinal axis in a direction of travel and, further, having lateral hand gripping means including velocity-control means. Internally to the hull is provided energy storage means, in the nature of a battery, and power control and transfer means therefore in an air space within said hull which air space also comprises buoyancy means for the vehicle. Depending integrally downwardly from said hull is a propeller shroud which extends from a central lower surface of the hull. In said propeller shroud is a propeller and motor therefor, which propeller is mounted within said shroud and transverse to said longitudinal axis of said hull, said motor being in electrical communication with said energy transfer means within said hull and subject to actuation by a user of said hand grip-controlled velocity control means.

It is an object of the present invention to provide a submersible marine vehicle operable both upon and beneath the water, which will afford to an user of such vehicle improved safety, maneuverability, and visibility in the use thereof.

It is another object to provide a submersible marine vehicle of the above type having enhanced range and velocity as compared to prior art marine vehicles suitable for use by a scuba diver.

It is a further object of the present invention to provide a submersible marine vehicle having a positive buoyancy when not loaded and a negative buoyancy when the weight of a scuba diver is added thereto.

It is a yet further object to provide a marine vehicle of the above type which is light enough to be transported, without the usage of special lifting equipment, outside of a body of water.

It is a still further object of the present invention to provide a submersible marine vehicle capable of diving to depths of about 150 feet, having a lesser hull thickness than hull thicknesses of previously known submersible marine vehicles.

The above and yet other objects and advantages of the present invention will become apparent from the hereinafter set forth Brief Description of the Drawings, Detailed Description of the Invention and Claims appended herewith.

DETAILED DESCRIPTION OF THE INVENTION

Figure 2:
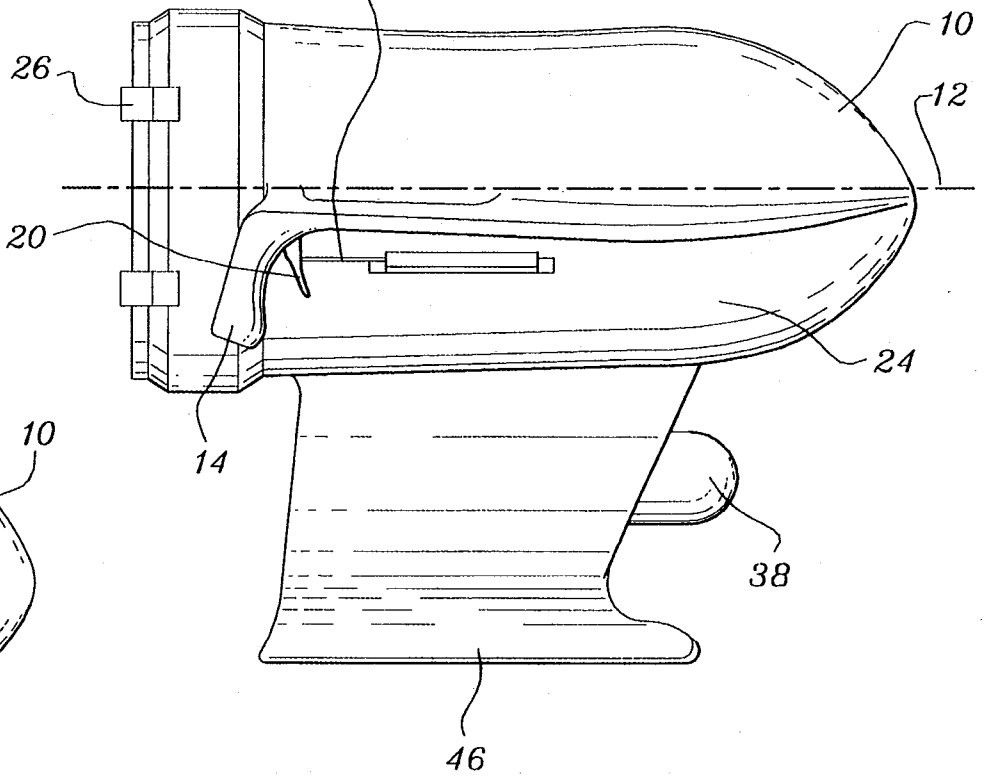
FIG. 2 is a side elevational view thereof.
Figure 1:
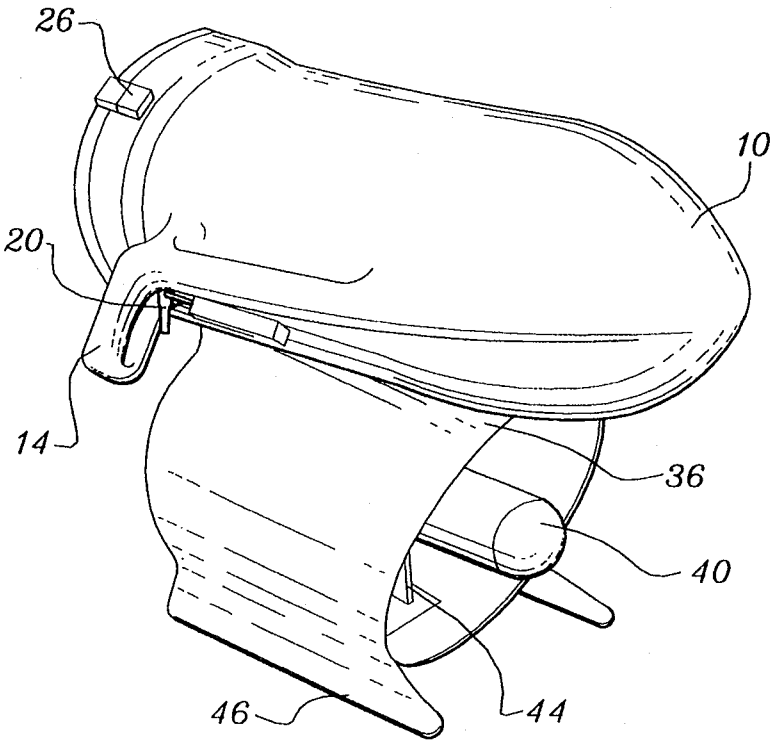
FIG. 1 is a front perspective view of the inventive marine vehicle.
Figure 3:
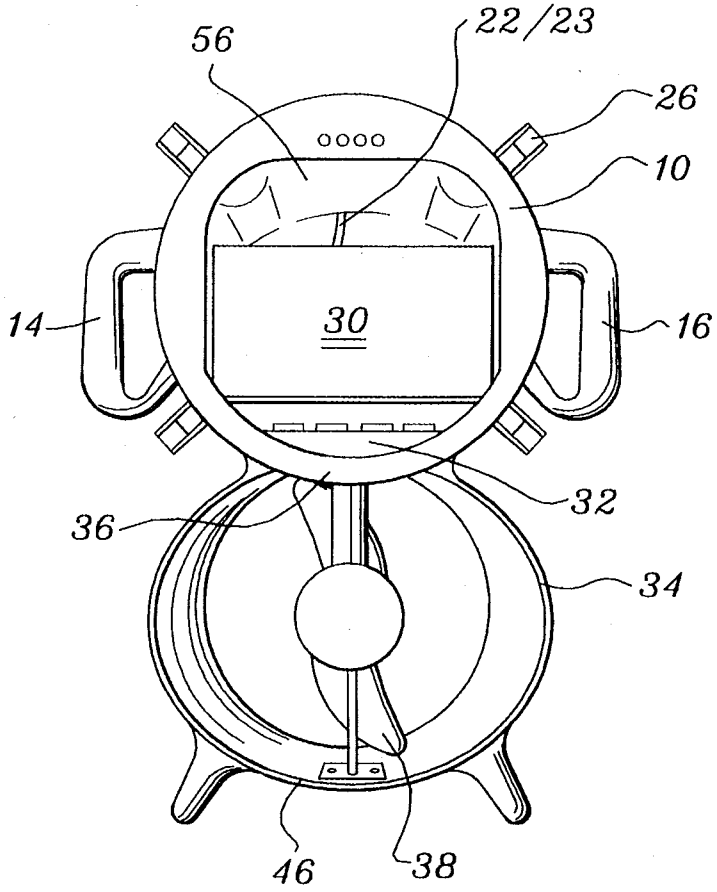
FIG. 3 is a rear elevational view of the marine vehicle.

With reference to the views of FIGS. 1 thru 3, the instant submersible marine vehicle may b seen to include an elongated fluid-tight bullet-like hull 10 which is radially symmetric about a longitudinal axis 12 which axis also represents the direction of travel of the vehicle. Also shown in the figures are left and right integral gripping means or handles 14 and 16. Portions of each handle are co-parallel with said axis 12. As may be noted, these handles are symmetric about a vertical plane upon which top longitudinal gripping means 18 are disposed.

The hull is preferably formed of a polymeric material such as polyethylene having a thickness of about 0.600 inches for diving depths of 150 feet.

Mounted upon each of said handles 14 and 16 are velocity means 20 and 21 respectively which actuate respective cables 22 and 23 which enter internally into hull 10 for operation with the relays of power control board 32, as is described below.

Further shown in the view of FIG. 2 are longitudinal channels 24, the function of which is to enhance the resistance of hull 10 to external pressures occurring at depth. In the absence of such channels 24, a greater thickness of the hull would be necessary to enable the use of the vehicle at like depth.

Figure 4:
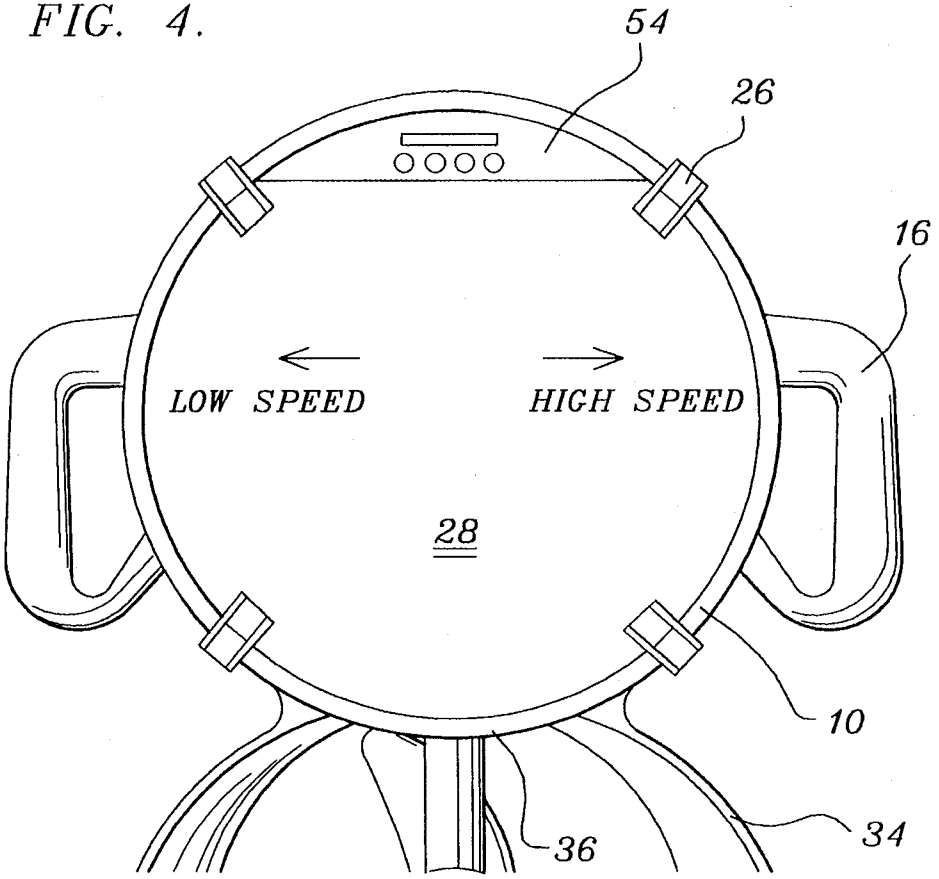
FIG. 4 is an enlarged view of the rear surface of the vehicle.

Further shown in FIGS. 1 thru 3 are control plate release means 26, the function of which is to enable the release of control plate 28 (see FIG. 4). After the plate 28 has been removed, the internal arrangement of the parts can be seen, as is shown in FIG. 3. Therein may be seen battery 30 and control board 32, later described below.

With further respect to the views of FIGS. 1 thru 3, there is shown propeller shroud 34 which depends integrally downwardly from a central lower surface 36 of the hull 10. As may be noted in FIGS. 1 and 3, a propeller 38 and motor 40 are mounted within said shroud 34 using vertical members 42 and 44, one of which depends downwardly from said area 36 and the other of which depends upwardly from a flat base 46 of the shroud 34. As may be noted in the view of FIG. 2, the axle of propeller 38 is parallel with the longitudinal axis 12 of hull 10. As may be also noted in the view of FIG. 3, the span or diameter of propeller 38 is approximately equal to the interior diameter of hull 10, this comprising a design feature which lends stability to the inventive vehicle. It is further noted that the plane of rotation of propeller 38, if virtually extended, would interest portions of handles 14 and 16.

With further reference to FIG. 2, it is to be noted that the combined longitudinal dimension of shroud 34 and motor 40 comprises between 60% and 110% of the longitudinal dimension, as measured upon longitudinal axis 12, of the hull 10.

Figure 5:
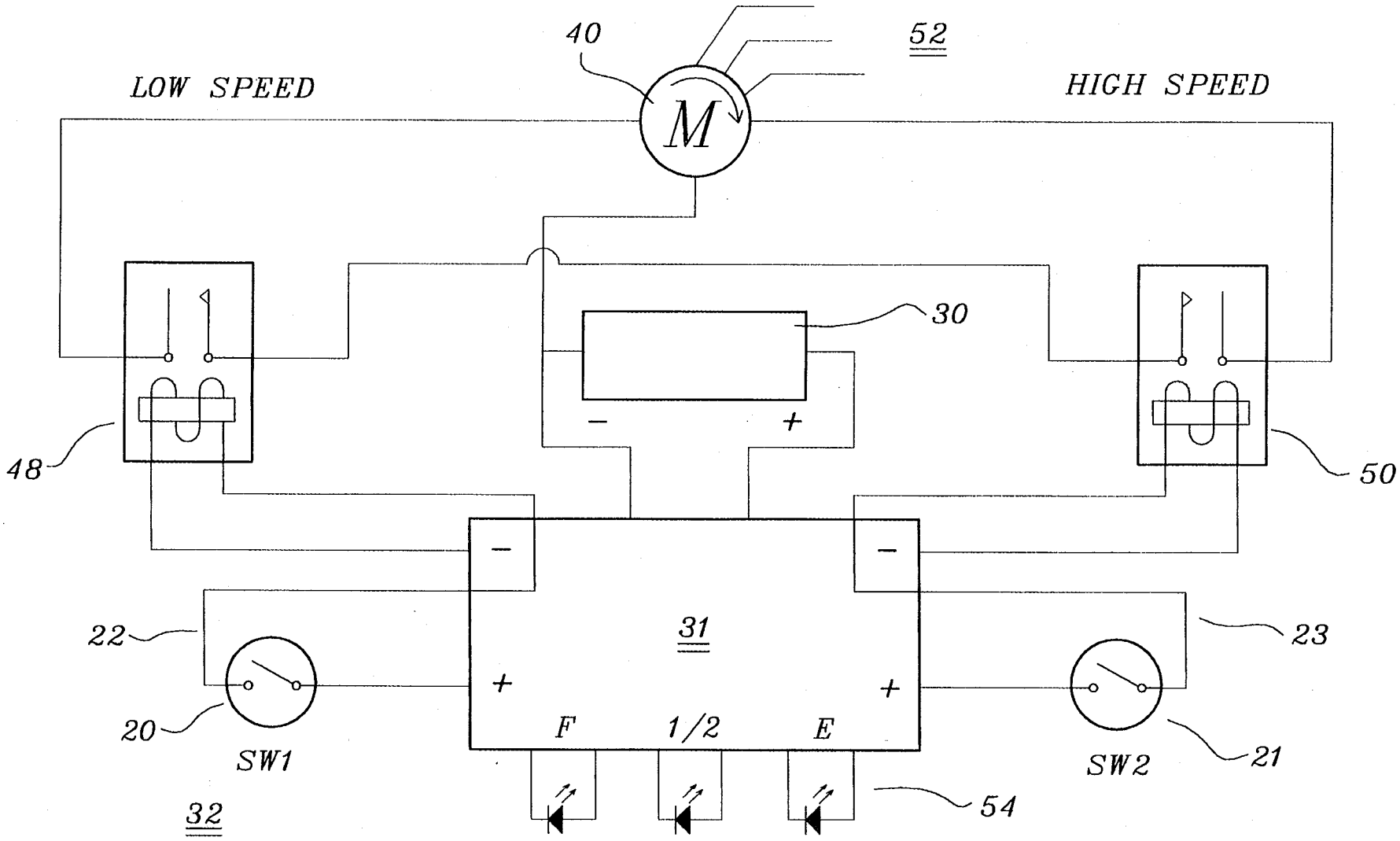
FIG. 5 is an electrical schematic of the power control system of the submersible vehicle.

In the view of FIG. 4 is shown the various indicators on the rear control plate 28 which indicate to the user which velocity control means correspond to which speed. In other words, said velocity control means 20 connects to cable 22 which, as is shown in FIG. 5, communicates to the low speed relay 48 while cable 23, from opposite velocity control means 21, connects to high speed relay 50. Both cables 22 and 23 pass through display control module 31 providing visual confirmation to the user of which velocity control means 20 or 21 has been actuated. Therefrom, said cables 22 and 23 will pass through relays 48 and 50 respectively and, therefrom, to motor 40. As may also be noted in FIG. 5, motor 40 is provided with the capability of operation at additional speeds through the provision of extra taps 52 that may be employed, as desired, to achieve other motor speeds.

Also shown in FIGS. 4 and 5 are LED displays 54 which indicate the level of remaining battery power in battery 30. More particularly, the indicia "E" indicates empty, "½" indicates power, and "F" indicates full power. Accordingly, a diver will be advised when the remaining battery power reaches one-half so that he will realize that return to his base of operations must begin. Viewing plate 28 may also be provided with a depth gauge.

One result of the inventive vehicle is that a scuba diver is provided with the option of either snorkeling on the surface, without the problem of prop wash or the motor obstructing his immediate view, or of operating below surface wherein the location of propeller 38 is sufficiently below and forward of the diver to permit an unobstructed view of the sea bottom or reef that is travelled over.

It is contemplated that battery 30 will comprise a rechargeable direct current charger of 12 to 24volts with about 3 to 10 amperes so that, between diving, the battery can be recharged without removal from air space 56 within the hull 10. It is noted that the present vehicle does not draw any voltage or current when the velocity control means 20 and 21 are not engaged, Therefore, unlike prior art systems, a diver can elect to employ the vehicle either in a power-on or power-off mode. Also, the electronics of the instant system are, as may be noted in FIG. 5, extremely simply i.e., the only functions of the control board 32 are those motor power output control and display of remaining battery power.

It is, finally, noted that air space 56 is carefully selected, in volume, to provide a desired positive buoyancy of two pounds.

Figure 6:
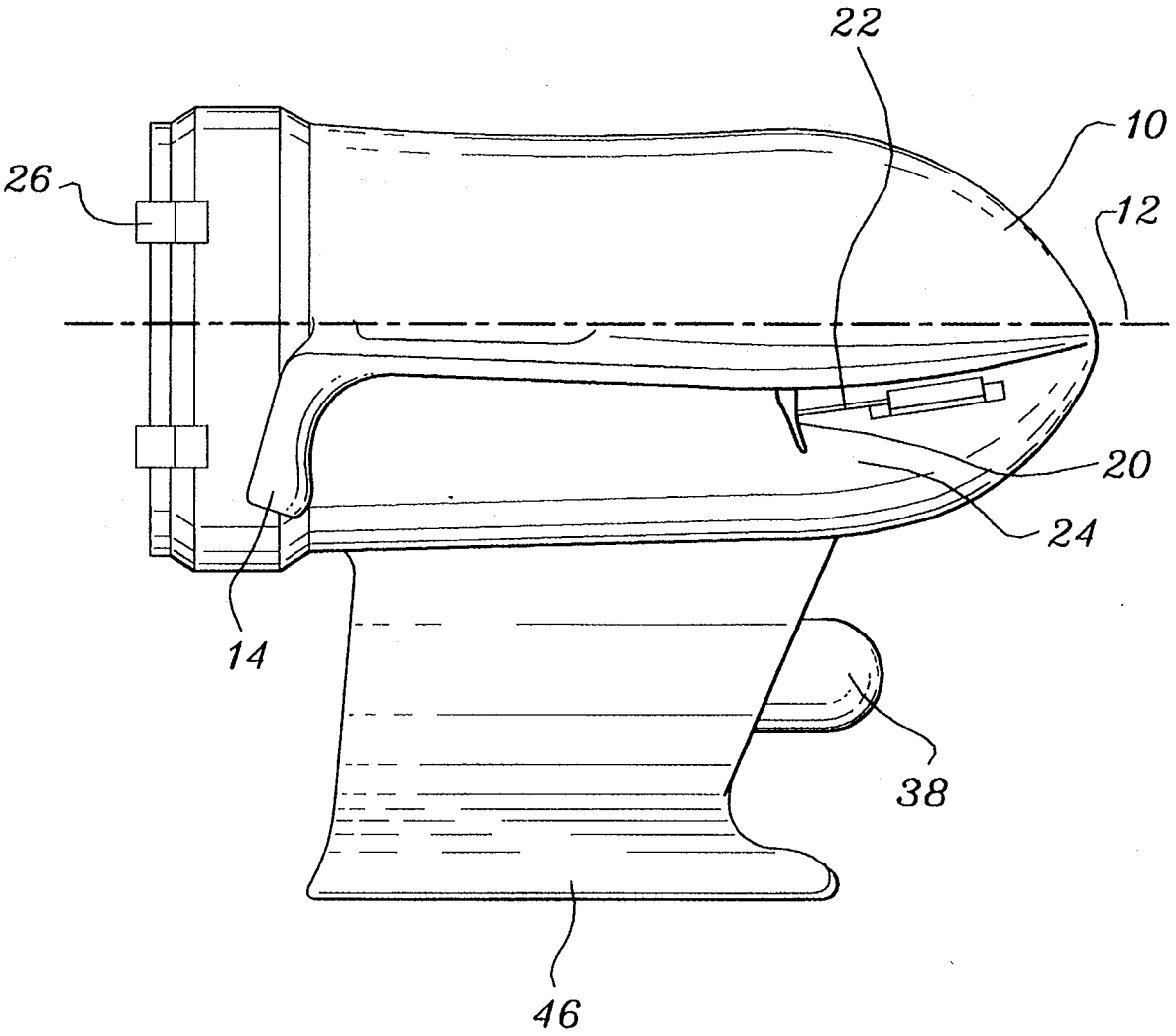
FIG. 6 is a side elevational view of a further embodiment of the present invention.

In the view of FIG. 6 is shown a further embodiment of the invention in which handles 20 are positioned toward the front of hull 10.

Accordingly, while there has been shown and described the preferred embodiment of the present invention it is to be understood that the invention may be embodied otherwise than is herein specifically shown and described and that, within said embodiment, certain changes may be made in the form and arrangements of the parts without departing from the underlying idea or principles of this invention within the scope of the Claims appended herewith.

Having thus described our invention what we claim as new, useful and non-obvious and, accordingly, secure by Letters Patent of the United States is:

1. A submersible dive marine vehicle, comprising:

(a) a fluid-tight hull elongated along a longitudinal axis corresponding to an intended direction of travel, said hull having integral gripping means and including velocity control means proximal to each of said gripping means, said hull further including, internally therewithin, energy storage means including power control and transfer means therefor within an air space in said hull, said hull defining a total longitudinal dimension co-linear to said longitudinal axis of said hull;

(b) a single axially hollow circumferential propeller shroud depending integrally downwardly from a lower surface of said hull along an axis transverse to said axis of said hull and said propeller shroud including a substantially flat bottom; and (b) a propeller and motor therefor, said propeller mounted within said shroud parallel to said axis of said hull, said propeller having a diameter approximately equal to an interior diameter of said shroud, said propeller and motor defining an aggregate longitudinal dimension parallel to said axis of said hull, said aggregate dimension in the range of about 60% to about 110% of said longitudinal dimension of said hull, said motor in electrical communication with said power transfer means within said hull, and subject to actuation by said velocity control means.

2. The marine vehicle as recited in claim 1, in which said energy storage means comprises a rechargeable direct current battery and said propeller motor comprises a direct current motor.

3. The vehicle as recited in claim 1, in which said air space of said hull comprises positive buoyancy means.

4. The vehicle as recited in claim 3, in which a diameter of said propeller is approximately equal to a diameter of said hull as measured transversely to said longitudinal axis thereof.

5. The vehicle as recited in claim 1, in which said velocity control means includes power regulation means in electrical communication with an electrical input of said motor.

6. The vehicle as recited in claim 1, in which a viewing plate includes indicators for velocity, power level and vehicle depth.

7. A submersible dive marine vehicle, comprising:

(a) a fluid-tight elongated hull having a longitudinal axis in an intended direction of travel and having integral lateral hand gripping means, said means including velocity control means, said hull having internally therewithin energy storage means, including power control and transfer means therefor within an air space in said hull, said air space also comprising buoyancy means for said vehicle;

(b) an axially hollow circumferential propeller shroud depending integrally downwardly from a lower surface of said hull and said propeller shroud including a substantially flat bottom; and (c) a propeller and motor for rotation thereof, said propeller mounted in said shroud transverse to said longitudinal axis of said hull, said motor in electrical communication with said energy transfer means within said hull and subject to actuation by said velocity control means.

8. The marine vehicle as recited in claim 7, in which said energy storage means comprises a rechargeable direct current battery and said motor comprises a direct current motor.

9. The vehicle as recited in claim 7 in which said hull includes a releasably detachable viewing plate situated upon a rearward cross-section of said hull between said gripping means.

10. The vehicle as recited in claim 9, in which said air space of said hull comprises positive buoyancy means.

11. The vehicle as recited in claim 7, in which a diameter of said propeller is approximately equal to a diameter of said hull as measured transversely to the intended direction of travel.

12. The vehicle as recited in claim 9, in which said velocity control means include a power regulation means in electrical communication with an electrical input of said motor.

13. The vehicle as recited in claim 9, in which said viewing plate includes an indicator for velocity, power and vehicle depth.

* * * * *